United States Patent [19]

Wakefield et al.

[11] Patent Number: 4,688,623

[45] Date of Patent: Aug. 25, 1987

[54] TEXTURED SILICON RIBBON GROWTH WHEEL

[75] Inventors: G. Felix Wakefield, Woodland Hills; David L. Bender; Samuel N. Rea, both of Thousand Oaks, all of Calif.

[73] Assignee: Atlantic Richfield Company, Los Angeles, Calif.

[21] Appl. No.: 554,752

[22] Filed: Nov. 22, 1983

Related U.S. Application Data

[63] Continuation of Ser. No. 333,071, Dec. 21, 1981, abandoned.

[51] Int. Cl.[4] ..... B22D 11/01; B22D 11/06

[52] U.S. Cl. ..... 164/423; 164/429; 118/262; 422/245

[58] Field of Search ..... 156/622, 624, DIG. 88; 422/246, 245; 118/DIG. 15, 244, 262; 23/295 R, 301; 423/348; 164/479, 462; 264/310

[56] References Cited

U.S. PATENT DOCUMENTS

| | | | |
|---|---|---|---|
| 3,605,863 | 9/1971 | King | 164/156 |
| 4,211,821 | 7/1980 | Hadni | 156/622 |
| 4,212,343 | 7/1980 | Narasimhan | 164/64 |
| 4,289,571 | 9/1981 | Jewett | 156/617 H |
| 4,333,792 | 6/1982 | Smith | 156/612 |

*Primary Examiner*—John Doll
*Assistant Examiner*—Robert M. Kunemund
*Attorney, Agent, or Firm*—Albert C. Metrailer

[57] ABSTRACT

Apparatus for production of semiconductor ribbon materials of the type in which molten material is brought into contact with the surface of a rotating cool wheel or drum wherein the cooling surface of the drum is textured to form a plurality of discrete contacting points to enhance growth of large crystal grains.

1 Claim, 6 Drawing Figures

TEXTURED SILICON RIBBON GROWTH WHEEL

This application is a continuation of application Ser. No. 333,071, filed Dec. 21, 1981, now abandoned.

BACKGROUND OF THE INVENTION

References known to the Applicants and believed to be relevant to the present invention are U.S. Pat. No. 3,605,863 issued to King on Sept. 20, 1971 and U.S. Pat. No. 4,289,571 issued to Jewett on Sept. 15, 1981. These two patents are hereby incorporated by reference for their teaching of apparatus and methods for formation of ribbon materials which are generally applicable to formation of semiconductor ribbons. The present invention includes apparatus which may be used with that taught in these two patents to produce improved semiconductor ribbon material.

As taught in the above-referenced Jewett patent, various efforts have been made to grow monocrystalline ribbons of semiconductor material, such as silicon, directly from a molten mass of such material. If techniques for growing such materials can be perfected, the final cost of materials suitable for use in photovoltaic cells should be considerably less than that of wafers cut from monocrystalline boules grown by the Czochralski technique. Methods such as those taught by the two above-referenced patents have resulted in the growth, at least on an experimental basis, of semiconductor ribbons. However, these ribbons are generally formed of polycrystalline material having grains or crystallites with maximum dimensions ranging between 0.1 and 2.0 mm. Attempts to properly control melt temperature in the growth zone of horizontal systems such as that taught in the Jewett patent, have often resulted in propagation of dendrites which, in addition to not being a single crystal structure, cause rough surfaces and inhibit thickness control. Various prior art studies (see, for example, U.S. Pat. No. 4,256,681 issued to Lindmayer on Mar. 17, 1981) of polycrystalline silicon indicate that grains having a diameter of at least one millimeter are necessary to produce high efficiency solar cells. A smooth surface is, of course, necessary to allow processing of semiconductor ribbons into completed photovoltaic cells.

SUMMARY OF THE INVENTION

Accordingly, an object of the present invention is to provide improved apparatus for producing semiconductor ribbon materials.

Another object of the present invention is to provide apparatus for forming large grains in polycrystalline semiconductor ribbons.

Yet another object of the present invention is to provide improved apparatus and method for inducing the growth of relatively large grains upon the formation of semiconductor ribbons from a melt.

Apparatus according to the present invention includes a ribbon forming wheel for contacting a molten mass of semiconductor material, said wheel having a textured surface for providing a plurality of raised contacting points spaced apart by a desired crystal grain size. Ribbon growth methods according to the present invention include contacting a molten body of semiconductor material with such a textured wheel to form a thin ribbon of solid semiconductor material on the wheel having large crystal grains induced by the textured surface.

BRIEF DESCRIPTION OF THE DRAWINGS

The present invention may be better understood by reading the following detailed description of the preferred embodiments with reference to the accompanying drawings wherein.

DESCRIPTION OF THE PREFERRED EMBODIMENTS

Figure 1:
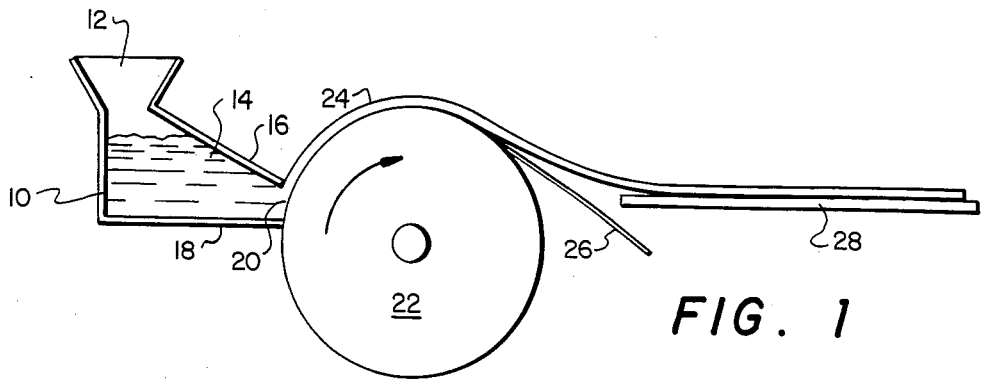
FIG. 1 illustrates a first embodiment of a semiconductor ribbon growth machine according to the present invention.

With reference now to FIG. 1, there is illustrated a semiconductor ribbon growth technique like that taught in above-referenced King patent. In FIG. 1, there is provided an essentially closed tundish 10 formed from quartz plates. Tundish 10 has an upper opening 12 into which molten silicon may be continuously poured to maintain a body of molten silicon 14. Upper and lower quartz plates 16 and 18 form a narrow opening 20 adjacent a rotating cooled wheel 22. The wheel or drum 22 preferrably is formed of high melting temperature material such as stainless steel at least on its outer circumference which contacts molten silicon at the opening 20. As the molten material contacts wheel 22, a thin layer solidifies on the wheel and is carried upward and over the top of the wheel in the form of a ribbon 24. In general, some type of scraper 26 is provided for lifting ribbon 24 from the surface of wheel 22 and guiding it to a support 28 where the ribbon may be collected and cooled. Mechanisms for rotating wheel 22 and maintaining the wheel surface at a prescribed temperature have been omitted from FIG. 1 for simplicity. However, unlike the smooth wheel surface employed in the above-referenced King patent, the outer surface of wheel 22 is intentionally textured. Texturing in the form of various groove and ridge patterns is illustrated and will be described below with respect to FIGS. 3 through 6.

Figure 2:
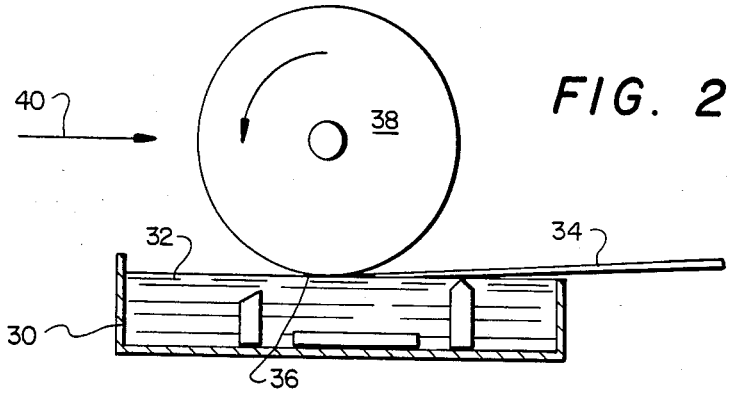
FIG. 2 illustrates a second semiconductor ribbon growth apparatus according to the present invention.

With reference now to FIG. 2, there is illustrated the basic structure of a horizontal ribbon growth apparatus similar to that disclosed in the above-referenced Jewett patent. A crucible 30 holds a molten mass of semiconductor material 32 such as silicon. A seed crystal 34 has a first end contacting the top surface of the melt at 36. A heat extractor wheel 38 is positioned over crucible 30 to contact the top surface of the melt also at point 36. Wheel 38 is driven to rotate in the direction of and at the speed of growth of ribbon 34 from melt 32. A drive mechanism and cooling arrangement such as that taught in the above-referenced King patent are also provided for wheel 38. Wheel 38 may be essentially identical to wheel 22 and has a textured silicon contacting surface such as that described below with reference to FIGS. 3 through 6. In horizontal ribbon growth processes with this type of equipment, the most difficult part of the process often involves establishing and maintaining the initial temperature gradient necessary for ribbon growth from the melt. Wheel 38 is believed to be particularly suitable for this initial start-up phase of the process since its textured surface will establish a plurality of crystal nucleation sites with controlled heat extraction which should prevent the initiation of dendritic growth. Once ribbon growth has been established, it may be possible to lift wheel 38 away from the surface of melt 32 and continue the growth with conventional methods. However, if desired, wheel 38 may remain in contact with the surface and be rotated continuously during the ribbon growth process.

Figure 3:
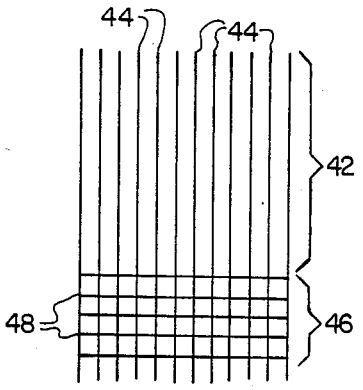
FIG. 3 is a plan view of the outer surface of a ribbon forming wheel showing grooved patterns according to the present invention.

With reference now to FIG. 3, there is illustrated texturing patterns which have been used on various ribbon-forming wheels. Such a pattern would be seen by viewing the edge of wheel 38 in FIG. 2 from the direction indicated by arrow 40. In the upper part of FIG. 3, a simple parallel groove pattern 42 is illustrated running lengthwise along the semiconductor contacting surface of wheel 38. The actual contours of individual grooves 44 is illustrated in more detail in FIGS. 4 through 6. In a preferred embodiment, grooves 44 were cut longitudinally, as illustrated, with a groove-to-groove spacing of approximately one mm. Wheels 22 and 38 are typically from two to four inches wide and it can, therefore, be seen that the illustration of FIG. 3 is not to scale. In the lower portion of FIG. 3, an area 46 is illustrated with additional grooves 48 cut transversely across the semiconductor contacting face of wheel 38 or 22. The net result of the double groove pattern 46 is a series of islands or point contacts formed by the ridges remaining between the grooves. In contrast, the area 42 has silicon contacting surfaces in the form of continuous linear ridges between the grooves. Both types of patterns have been found effective in inducing larger crystal grains arranged in patterns corresponding to the groove pattern.

Figure 4:
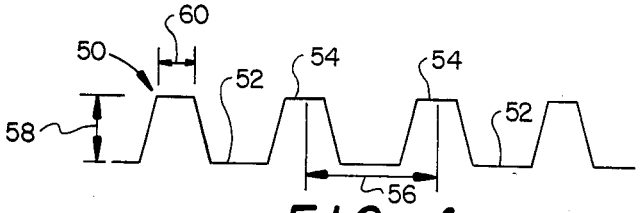
FIGS. 4, 5 and 6 are cross-sectional illustrations of groove configurations according to the present invention.

With reference now to FIG. 4, there is illustrated, in cross-sectional view, a groove and ridge pattern 50 which has been used successfully to produce ribbons having good grain structures. The pattern 50 consisted of a series of longitudinal grooves 52 as illustrated in the area 41 in FIG. 3. As a result, a series of parallel ridges 54 which provide discrete spaced-apart contact points for the molten semiconductor material are provided. In an experimental wheel, the spacing between grooves 52 and, therefore, between ridges 54 was approximately one mm as indicated by the arrow 56. Groove depth as indicated by the arrow 58 was approximately 0.2 mm. The width of the top of ridges 54 as indicated at 60 was approximately 0.1 mm. This textured surface produced ribbon having rows of crystal grains having approximately a one mm diameter which appeared to have grown laterally from the tops of the ridges 54 until a grain growing from an adjacent ridge was encountered approximately midway across a groove 52.

Figure 5:
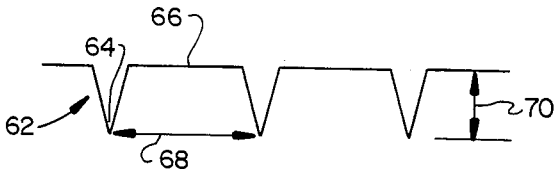

With reference to FIG. 5, there is illustrated another groove pattern 62 having different proportions between the width of grooves 64 and ridges 66. The spacing 68 between adjacent grooves 64 has been varied between 0.4 mm and one mm while the depth 70 of groove 64 has been varied between about 0.05 mm and 0.1 mm. Ribbon material produced with the various patterns fairly consistently is formed of crystal grains having a diameter roughly equal to the spacing 56 or 68 between adjacent grooves. The simple longitudinal patterns as indicated by the area 42 in FIG. 3 tend to produce identifiable rows of crystal grain having random length in the direction of growth along the length of the grooves. Use of cross grooves such as indicated by the area 46 in FIG. 3 tends to make the crystal grain structure more regular in the direction of growth as well, that is, a rectangular grain structure resulted. Alternate texture patterns which may be used to achieve other grain structures and sizes include a hexagonal array of nucleation points to provide a hexagonal grain array.

Figure 6:
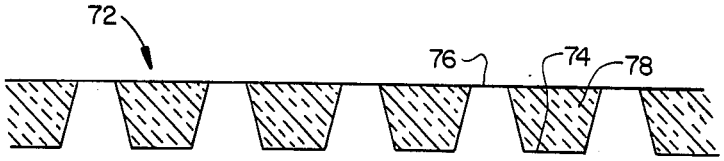

With reference now to FIG. 6, there is illustrated yet another groove or ridge arrangement 72. Dimensions of grooves 74 and resulting ridges 76 may correspond to those illustrated in FIGS. 4 and 5. However, in FIG. 6, the grooves 74 have been filled with an insulating material 78. It is expected that a ceramic cement such as that sold under the trademark Sauereisen TM by Sauereisen Cements Company would be suitable for use as insulating material 78. After the grooves 74 have been cut into the surface of a wheel, the cement may be troweled into the grooves. After the cement has set, the wheel surface may be machined to provide an essentially smooth top surface formed alternately by the ridges 76 and the ceramic material 78. While material 78 is referred to as an insulating material, it is only necessary that material 78 have a lower thermal conductivity than the bulk material, such as stainless steel, from which the wheel ridges 76 are formed. This FIG. 6 arrangement has been proposed as a manner of insuring a smooth ribbon surface while achieving the large crystal grain structure which results from providing the textured surface. That is, ridges 76 will provide the major cooling path to the molten semiconductor material and thereby act as nucleation points from which large crystal grains should grow. The insulating material 78 would primarily act as a mechanical support to the liquid silicon to prevent deformation of the ribbon during the solidifying process. This filled groove arrangement permits the ridge spacing to exceed one mm.

Experiments with the grooved and ridged pattern of FIGS. 4 and 5 indicate that, at least within practical ridge spacings, there may be no advantage in filling the grooves 74 with an insulating material as indicated in FIG. 6. As noted above, it is generally believed that high efficiency cells can be manufactured from polycrystalline silicon having grain sizes which average one mm in diameter. Thus, it appears that a practical ridge or groove spacing is one mm. Initial experiments indicate that larger spacing between the tops of ridges may prevent the complete growth of material between the ridges so that a ribbon cannot be formed. However, within the one mm range, there has been essentially no problem with the molten material flowing into the grooves as might be expected. The material during growth quite easily bridges the grooves with the result that an essentially flat bottom ribbon surface is formed. The use of the insulating material 78 will probably be necessary if spacing between ridges 76 is increased much beyond one mm. With such spacing, the material 78 would prevent drooping into the ridge spaces which might otherwise occur and may, in fact, provide sufficient support of the liquid silicon between the ridges to help fill in the ribbon while still allowing large crystal grain structures to be formed.

As noted above, we believe that the present invention enhances growth of larger crystal grains by providing discrete nucleation points. The textured surface also has the effect of reducing the average rate of heat extraction from the liquid and the solidifying ribbon. This results in a reduction in the rate of solidification and thereby allows larger grain growth and reduced stresses in the ribbon.

While the present invention has been illustrated and described with respect to particular apparatus, it is apparent that various modifications and changes can be made within the scope of the present invention as defined by the appended claims.

What we claim is:

1. An apparatus for the production of semiconductor ribbon in which molten semiconductor material is brought into contact with the outer circumference of a cool rotating wheel, the improvement comprising:

a wheel having a textured semiconductor contacting surface, said surface comprising a plurality of grooves formed in said surface and spaced, center to center, more than one millimeter apart, wherein said grooves are filled with an insulating material having lower thermal conductivity than the conductivity of material in which said grooves are formed, said insulating material and ridges between said grooves forming a smooth outer wheel surface.

* * * * *